US006840552B2

(12) United States Patent
Ramsauer

(10) Patent No.: US 6,840,552 B2
(45) Date of Patent: Jan. 11, 2005

(54) LOCK FOR ASSEMBLY IN AN OPENING IN A THIN WALL

(76) Inventor: Dieter Ramsauer, Max-Klein-Str. 10, 58332 Schwelm (DE)

( * ) Notice: Subject to any disclaimer, the term of this patent is extended or adjusted under 35 U.S.C. 154(b) by 7 days.

(21) Appl. No.: 10/240,808

(22) PCT Filed: Feb. 8, 2001

(86) PCT No.: PCT/EP01/01335

§ 371 (c)(1),
(2), (4) Date: Jan. 23, 2003

(87) PCT Pub. No.: WO01/79629

PCT Pub. Date: Oct. 25, 2001

(65) Prior Publication Data

US 2003/0151263 A1 Aug. 14, 2003

(30) Foreign Application Priority Data

Apr. 14, 2000 (DE) ..... 200 06 876 U

(51) Int. Cl.[7] ..... E05B 3/00
(52) U.S. Cl. ..... 292/336.3; 292/DIG. 31
(58) Field of Search ..... 292/336.3, DIG. 31

(56) References Cited

U.S. PATENT DOCUMENTS

| | | | | |
|---|---|---|---|---|
| 2,278,534 A | * | 4/1942 | Dickason | 292/336.3 |
| 4,693,503 A | | 9/1987 | Bisbing | |
| 5,238,276 A | * | 8/1993 | Burns | 292/347 |
| 5,267,762 A | | 12/1993 | Gromotka | |
| 5,340,174 A | * | 8/1994 | Bender et al. | 292/336.3 |
| 5,409,272 A | | 4/1995 | McCormack | |
| 5,440,905 A | * | 8/1995 | Yamada | 70/208 |
| 5,450,735 A | * | 9/1995 | Esaki et al. | 70/208 |
| 5,831,554 A | * | 11/1998 | Hedayat et al. | 341/20 |
| 6,263,712 B1 | * | 7/2001 | Ramsauer | 70/208 |

FOREIGN PATENT DOCUMENTS

| | | |
|---|---|---|
| DE | 35 04 691 | 11/1985 |
| EP | 0 054 225 | 6/1982 |
| JP | 9-53347 | 2/1997 |

OTHER PUBLICATIONS

Brochure F–4 published by Southco, Inc., Concordville, Pennsylvania, USA, entitled "Adjustable Lever Latch".

* cited by examiner

*Primary Examiner*—Gary Estremsky
(74) *Attorney, Agent, or Firm*—Reed Smith LLP

(57) ABSTRACT

The description relates to a closure for mounting in an opening in a thin wall, such as a sheet metal cabinet door, which comprises a housing and which has, at one end, a bearing support for an actuation lever and, at its other end, a lock device for the actuation lever and a fastening device such as a clamping clip therebetween. The housing has a partially spherical bearing surface with a cylindrical bore hole proceeding from it, wherein a partial ball with a first bearing for a closure drive shaft extending through the cylindrical bore hole and with a second bearing for the actuation lever is arranged in the cylindrical bore hole, and the two bearings enable a rotation of the partial ball in relation to the housing and a swiveling of the actuation lever in relation to the partial ball around an axis vertical to the closure drive shaft and to the extension of the lever.

7 Claims, 6 Drawing Sheets

LOCK FOR ASSEMBLY IN AN OPENING IN A THIN WALL

CROSS-REFERENCE TO RELATED APPLICATIONS

This application claims priority of PCT Application Serial No. PCT/EP01/01335, filed Feb. 8, 2001 and German Application No. 200 06 876.8, filed Apr. 14, 2000, the complete disclosures of which are hereby incorporated by reference.

BACKGROUND OF THE INVENTION a) Field of the Invention

The invention is directed to a closure for mounting in an opening in a thin wall such as a sheet metal cabinet door, a sheet metal cabinet flap, a sheet metal cabinet housing wall or the like with an elongated, substantially cup-shaped housing whose edge passes into a flange and which has, at one end, a bearing support for an actuation lever and, at the other end, a lock device for the actuation lever in its position in which it is swiveled into the housing, and a fastening device which clamps the thin wall between itself and the flange.

b) Description of the Related Art

A closure of the type mentioned above is already known from EP 0054225 A1 and also, for example, from U.S. Pat. No. 5,267,762. Further, reference is had to U.S. Pat. No. 4,693,503 and to brochure F-4 published by Southco, Inc., Concordville, Pa., USA, entitled "Adjustable Lever Latch".

The closures shown in the U.S. references are simple clamping closures and are locked by a clamping block which lies behind a surface formed by the door frame, housing frame or the like as a result of the pivoting movement of the actuation lever around an axis parallel to the wall surface or door leaf surface and accordingly achieves the locking effect. This means that the closure must always be arranged with its longitudinal extension perpendicular to the wall edge as is shown, for example, in FIG. 1 of U.S. Pat. No. 4,693,503. A further disadvantage consists in that the handling part of the pivoting handle must be pivotable by a relatively large angle, e.g., greater than 60°, so that the pressing surface formed by the other end of the lever is swiveled away sufficiently far so as not to impede the opening of the door.

On the other hand, this necessarily large pivoting angle requires sufficient space between the edge of the housing and the edge of the lever in the area of the swiveling axis to allow this edge to be tucked away inside. This space also remains clearly visible when the lever is folded in, is visually unappealing and can collect dirt or the like.

This relatively wide gap which is formed between the housing and pivoting lever and which is substantially conical in cross section is clearly shown in the top view shown in the brochure.

Another disadvantage of the device known from the U.S. references is that the closure automatically springs up when not sufficiently secured in its folded-in position due to outwardly directed spring forces, e.g., due to vibratory loading, and the closure therefore opens in an unwanted manner. The closure according to EP 0054225 does not have this disadvantage.

Another disadvantage shared by all of the references consists in that the closure can not be mounted blindly, i.e., the two sides of the thin wall in which the closure is to be mounted in a corresponding opening must be accessible; specifically, one side must be accessible for the insertion of the cup-shaped housing until the flange contacts the edges of the opening in the thin wall, and the other side must be accessible for screwing on union nuts or screw caps (EP 0054225) or for arranging a clamping clip in order to bring the clip into a clamping contact with the edge surface of the thin wall by means of a clamping screw whose head is likewise accessible on this side (U.S. patents).

OBJECT AND SUMMARY OF THE INVENTION

It is the primary object of the invention to combine and further develop the known closures in such a way that a shaft extending vertical to the door leaf plane can be driven in rotation in order to be able to drive, e.g., an espagnolet closure, possibly also with con-rod transmission, and so as to enable axial clamping displacement.

Further, the design should be carried out in such a way that there is no need for such a wide visible gap to enable the movement of the folding lever around its axis parallel to the door leaf plane.

Further, the lever should be capable of being constructed in such a way that it does not fold out automatically in the event that the locking of the folding lever inside the cup-shaped or dish-shaped housing arrangement becomes unstable or malfunctions, so that persons passing by the closure, for example, can not be injured by the projecting closure lever.

Finally, the closure should be capable of being constructed in such a way that it can also be blind-mounted, i.e., fastening is possible only from one side.

The principal object of the invention as well as some of the further objects are met in that the housing has a partially spherical bearing surface with a cylindrical bore hole proceeding from it, wherein a partial ball is provided with a first bearing for a closure drive shaft extending through the cylindrical bore hole and is provided with a second bearing for the actuation lever, which two bearings enable a rotation of the partial ball in relation to the housing and a swiveling of the actuation lever in relation to the partial ball around an axis vertical to the closure drive shaft and to the extension of the lever.

On one hand, this partial ball bearing support enables swiveling around an axis parallel to the door leaf plane; on the other hand, it also enables simultaneously a rotation around an axis vertical to this door leafplane. This makes it possible to carry out the lever swiveling movement (axial clamping movement) on the other hand and, on the other hand, also makes it possible after the lever is swiveled out of its housing to use this lever for driving the drive shaft for the closure which extends vertical to the door leaf plane (rotational movement).

The bearing support of a hand lever in a bearing that is outfitted with a partially spherical surface to enable swiveling as well as rotation of a hand lever is prior art per se (see, for example, the above-cited European Patent Application EP 0054225 A1, e.g., FIG. 5).

However, in the reference cited above, the partial ball forms an integral part of the handle, whereas the partial ball according to the invention itself forms a bearing support for the handle.

The separation of the partial ball from the actuation lever (two-part design) has special advantages as will become clear in the following.

In particular, it is advantageous that the closure according to the invention not only exhibits rotational driving around an axis vertical to the door leaf, but at the same time can also exert a clamping action through its axial displacement, that is, it combines the advantages of two closure systems, namely, the rotatability of the closure according to EP 0054225, for example, with the clamping action described in the U.S. references of the above-cited prior art. The combination of a rotary closure with a drive shaft (for additional clamping action) which is rotatable around an axis extending vertical to the door leaf plane on the one hand and which is displaceable in axial direction on the other hand results in special advantages in that it is possible that the bar or bolt of the closure is driven home and exerts a clamping action only after reaching the locking rotational position, so that the frictional loading of the arrangement is reduced. Closures in which the rotational action and clamping action are separated are also known per se (see, e.g., DE 3504691 C2, which shows a clamping closure with a sash fastener which can be operated by inserting a key).

In bar closures with sash fasteners for sheet metal cabinet doors, the closure according to the invention is particularly advantageous because when the bar locks move in at the upper end and lower end of the door frame, doors of this kind can warp such that the middle of the door bulges out and the distance from the middle of the door to the frame increases, as a result of which the distance between the sash lock bolt and its frame backgrip plane is too great, the bolt does not grasp the backgrip surface and the closing process is accordingly impeded. This can be compensated by the axial displacement of the drive shaft for the tongue.

According to a further development of the invention, the first bearing is formed by a slot which extends in the partial ball in the direction of the center of the ball and forms an annulus sector, the end of the closure drive shaft extends into the end of the slot and the slot has undercuts extending substantially coaxial to the annulus sector, a transverse pin arranged near the end of the closure drive shaft slides along at these undercuts.

This construction allows a movement of the partial ball around an axis extending parallel to the door leaf even when this axis is not identical to the axis of the transverse pin of the closure drive shaft. There is identity between the axes in EP 0054225.

These undercuts can be formed by grooves extending in the side walls of the slot or by slot-shaped openings. The latter construction is simpler to produce and also facilitates mounting.

In a particularly advantageous embodiment form, the sliding surfaces formed by the grooves or slot-shaped openings have a substantially continuously decreasing radial distance from the spherical surface in the direction of the end of the groove facing the cut-off end of the partial ball. This step makes it possible to change the axial position of the drive shaft which carries a sash fastener, for example, and accordingly to cause the desired clamping mechanism by swiveling the partial ball.

According to another embodiment form of the invention, the spacing at the opposite end of the groove decreases again to some extent. This has the advantage that the closure locks automatically in the clamping position because force must be applied in order to overcome this new decrease in groove spacing, which force tends to hold the clamping closure in the clamping position. Accordingly, a desired locking in results in the clamping position.

According to a further development of the invention, two oppositely located shoulders proceed from the cut-off surface of the partial ball and form bearings for a pin which forms the second bearing and on which pin the actuation lever is held so as to be swivelable against spring force. This makes it possible to swivel out the lever in a limited manner for actuating the closure independent from the movement of the ball, i.e., a desired free running can result between the lever movement and the ball movement around an axis extending parallel to the door leaf surface. Accordingly, the lever can be swiveled out by some distance in order for it to occupy a suitable handy position before greater forces need to be applied in order to move the ball either around an axis parallel to the door leaf surface or around the axis of the closure shaft extending perpendicular to the latter.

The spring force prevents the hand lever from springing out in an unwasted manner; instead, the spring generates a force which presses the lever into the closure position.

According to a further development of the invention, the shoulders can be formed by side walls which enclose the narrow sides of the shorter lever arm of the actuation lever at a slight distance so as to be tightly protected from dirt. This results in the desired visual uniformity of the entire arrangement without the wide gaps seen in the prior art which were visually bothersome and also collected dirt.

Since the movement of the lever in relation to the partial ball need only be small in contrast to the prior art and the swiveling out angle accordingly remains small, the required clearances are substantially smaller than in the prior art.

According to a further development of the invention, the cup-shaped housing is provided in the center of its longitudinal extension with a necked-down portion which can receive a fastening clip in such a way that when the legs of the clip are pressed together or are not pressed apart the outer alignment of the housing is not interrupted by these legs. Accordingly, in this rest position of the arrangement the body of the closure housing, including its fastening clip, can be inserted into a suitable opening in a thin wall by its front side up to the flange and then clamped in a suitable manner by means of screws or the like which tighten the clamping clip without the back of the thin wall having to be accessible.

This is achieved in a particularly simple way in that the housing has surfaces in the area of the leg ends of the fastening clip, which surfaces press the legs apart when the fastening clip is tightened until they strike edge areas located around the opening of a thin wall.

The fastening clip can also have legs which spring outward.

It is advantageous that a clamping screw which is used for this purpose can also be arranged in such a way that its head is accessible from the outside preferably only when the actuation lever is folded up. In this preferable case, the closure can not be dismantled by unauthorized persons when the actuation lever is locked.

According to a further development of the invention, the housing can receive a cylinder lock or the like in the area of the free end of the fastening lever when this fastening lever is folded in, and the closure thumb or closure finger of this cylinder lock grips behind a recess or offset of the actuation lever so as to lock. In this way, it is possible to secure the actuation lever in the swiveled-in position, specifically, by means of a safety key, for example. Alternatively, of course, a simple safety lever which can be triggered simply by thumb pressure or the like can also be used in a manner known per se as is shown in the prior art, e.g., in FIGS. 4 and 5 of U.S. Pat. No. 5,267,762.

BRIEF DESCRIPTION OF THE DRAWINGS

In the following, the invention will be explained more fully with the aid of embodiment examples shown in the drawings.

In the drawings.

DESCRIPTION OF THE PREFERRED EMBODIMENTS

Figure 1:
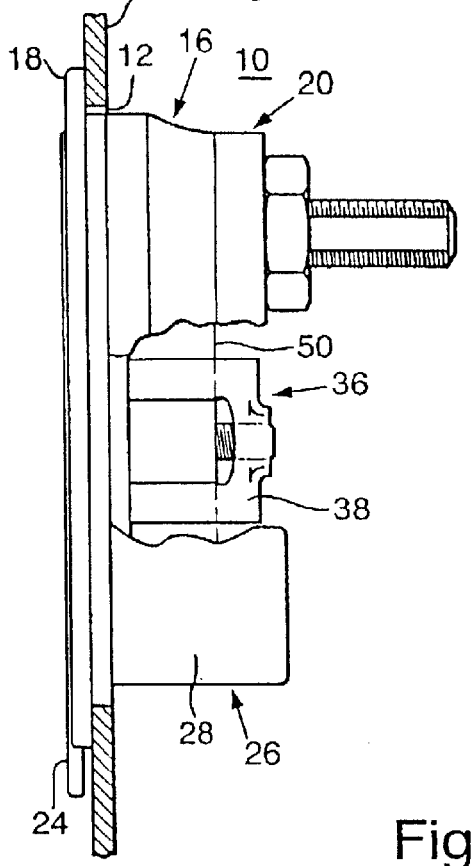
FIG. 1 is a side view showing an embodiment form of the closure according to the invention.

FIG. 1 is a side view showing a closure 10 which is mounted, e.g., in an elongated rectangular opening 12 in a thin wall 14 such as a sheet metal cabinet door, sheet metal cabinet flap, sheet metal cabinet housing wall or the like. The closure comprises an elongated, substantially cup-shaped housing 16 of injection-molded plastic or an injection-molded light alloy. The cup edge of the housing 16 passes into a flange 18 which forms contact surfaces for the four edge areas of the thin wall 14 around the opening 12 and accordingly secures the closure on the one hand and, on the other hand, covers the slots between the front edges of the opening and the circumferential surface of the housing body. A leaf seal, not shown, can be arranged in a manner known per se between the contact surface of the flange 18 and the edge area of the thin wall 14.

Figure 2:
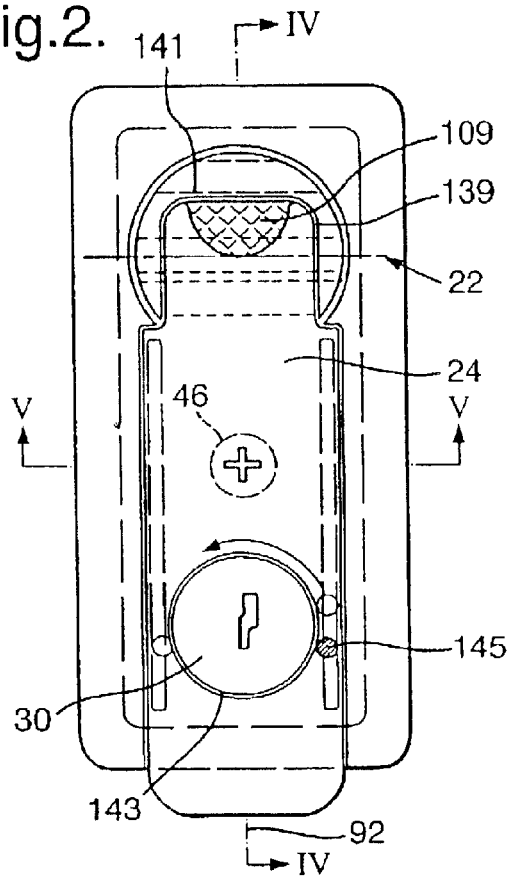
FIG. 2 shows a top view of the closure of FIG. 1.
Figure 3:
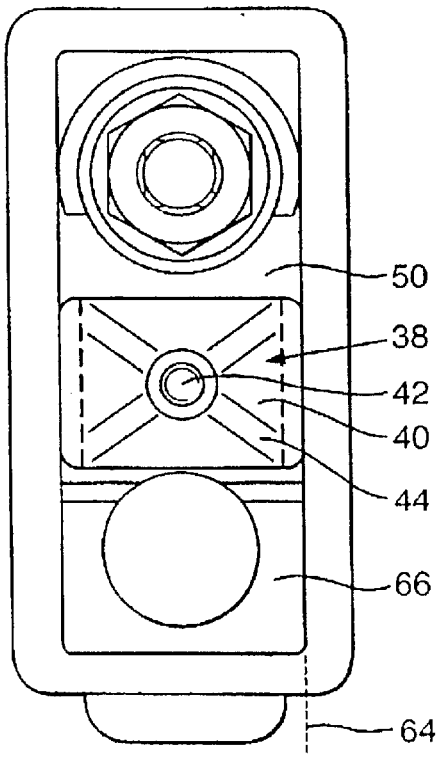
FIG. 3 shows a rear view of the closure according to FIG. 1.

At one end 20, the housing has a bearing support 22 which will be described more fully in the following (see FIG. 2 showing a top view of the arrangement according to FIG. 1). This bearing support 22 is provided for an actuation lever 24 which projects only a little, as is shown, or not at all, over the flange 18 of the housing, and the entire arrangement can accordingly be very flat as can be seen in FIG. 1.

A lock device 28 for an actuation lever 24 in its position in which it is swiveled into the cup-shaped housing is located at the other end 26 of the housing, 16. This lock device 28 is represented, for example, by a key-operated lock cylinder 30 which, in an axial sectional view through the arrangement according to the invention in FIG. 4, engages behind an offset or backgrip surface 34 in a locking manner by a closure thumb or closure finger 32 when the cylinder is rotated into the locking position by a corresponding key, not shown, and the actuation lever is folded into the position shown in FIG. 4. The locking can also be carried out in another manner, e.g., as is shown in EP 00554225.

A clamping fastening 36 is located between the housing end 20 with the actuation lever bearing support and the other end 26 with the lock device for the actuation lever. The clamping fastening 36 comprises a clip 38 which encloses the narrow side of the housing and which has a threaded socket 42 in the middle of its web surface 40 at the point of intersection of reinforcement beads 44. When the actuation lever is folded up, a cap screw 46 is arranged in this threaded socket and extends through a socket-reinforced bore hole 48 in the base 50 of the cup-shaped housing. When this screw is lightened, it causes the two supporting leas 54 which are formed by the two legs 52 of the clip 38 to be supported by their end faces 56 on edge areas 58 surrounding the opening in the thin wall and to clamp the thin wall 14 between themselves and the flange 18. In this connection, see FIG. 5 which shows a sectional view along line V—V of FIG. 2.

Figure 5:
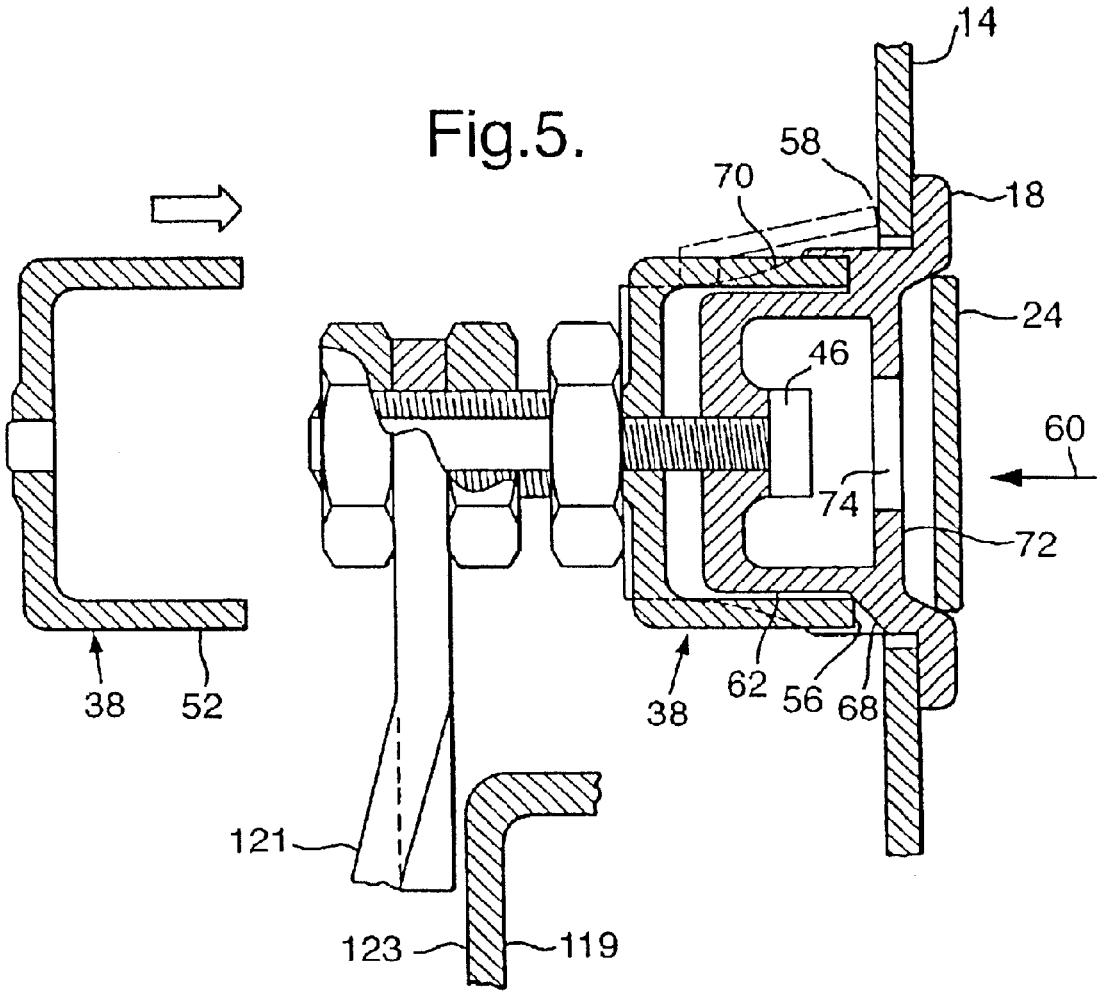
FIG. 5 shows a sectional view along section line V—V of FIG. 2 to illustrate the clamping devices.

In order to enable insertion of the closure, including the clip 38 that has already been mounted beforehand, from the outside (see arrow 60) for blind mounting in the opening in the wall 14, the cup-shaped housing 16 forms, e.g., in the middle of its longitudinal extension, necked-down portions (see 62) which can receive the legs 54 of the fastening clip 38 in such a way that the outer alignment 64 of the housing body 66 projecting through the opening 12 is not interrupted by the side legs 54 which are pressed together or have not yet been pressed apart. However, when the housing body is pushed through until the flange of the housing contacts the thin wall 14, as can be seen in FIG. 5, the screw 46 can be tightened and in so doing draws the clip 38 and therefore the leg ends with their end faces 56 in the direction of the thin wall 14. As can be seen from FIG. 5, the housing has sloping surfaces 68 or 70 in the area of the necked-down portions 62 at the lower end, the ends of the legs being pressed apart by means of these sloping surfaces 68 or 70 until they finally strike the edge areas located around the opening in the thin wall, as can be seen at 58 in FIG. 5. Alternatively, fastening clips with legs which spring outward somewhat and which automatically occupy the appropriate supporting position without sloping surfaces at the housing can also be used. The housing can also carry holding webs or holding shoulders which are formed integral with the housing and which spring away when the housing is inserted.

During this tightening of the screw 46, the actuation lever 24 must be folded away or turned away. When the housing is designed in such a way that the cup forms a hollow section in cross section for purposes of reinforcement as can be seen in FIG. 5 (see transverse wall 72), this transverse wall 72 has a round opening 74 in the area of the screw head 46 to allow insertion of the screw and so that the head of the screw 46 can be reached, e.g., with a screwdriver.

Figure 4:
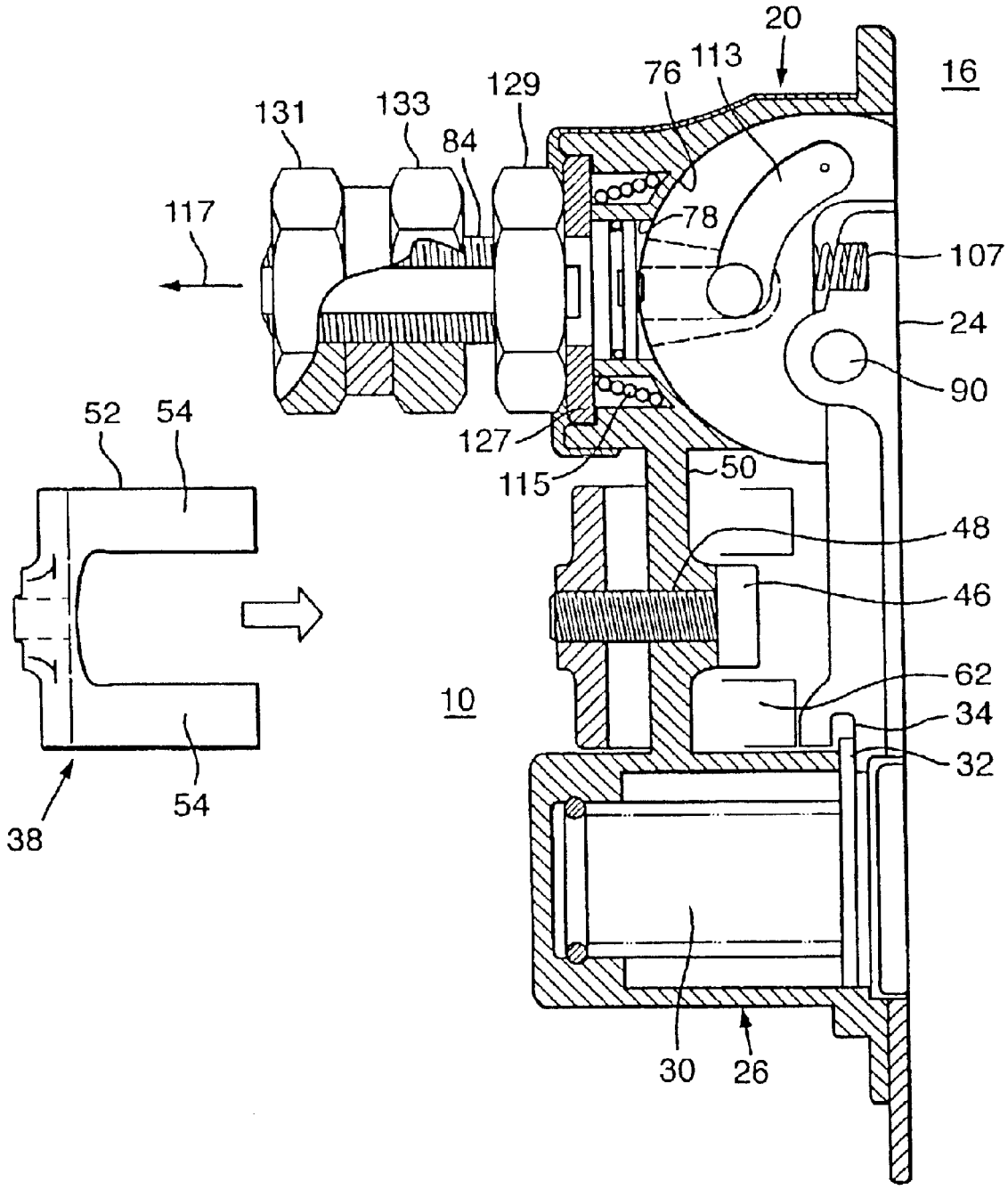
FIG. 4 shows an axial sectional view along section line IV—IV in FIG. 2.
Figure 6:
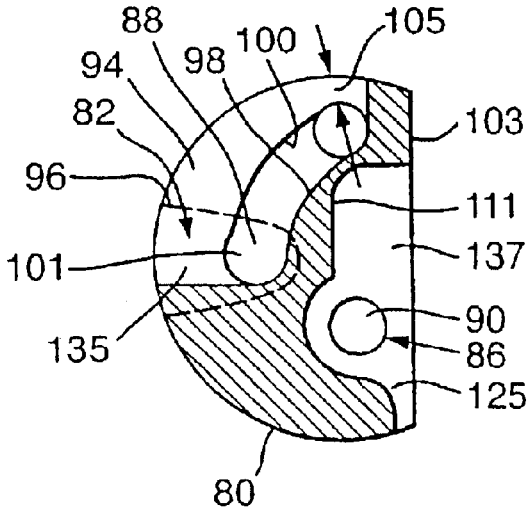
FIG. 6 shows a section through the partial ball along section line IV—IV of FIG. 2.
Figure 10:
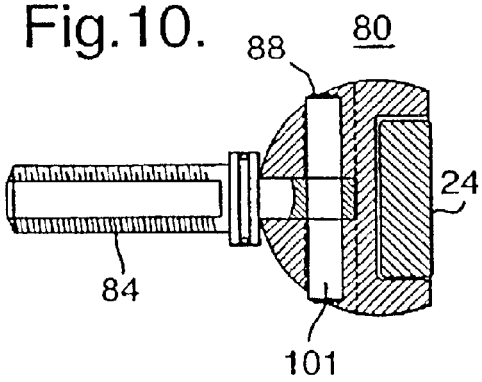
FIG. 10 shows a cross-sectional view through the partial ball and the hand lever along the axis of the inserted closure drive shaft.
Figure 9:
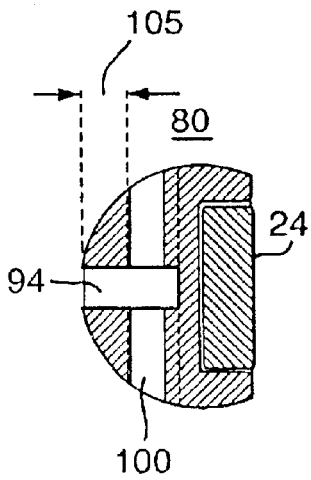
FIG. 9 shows a cross-sectional view through the partial ball and the hand lever.
Figure 11:
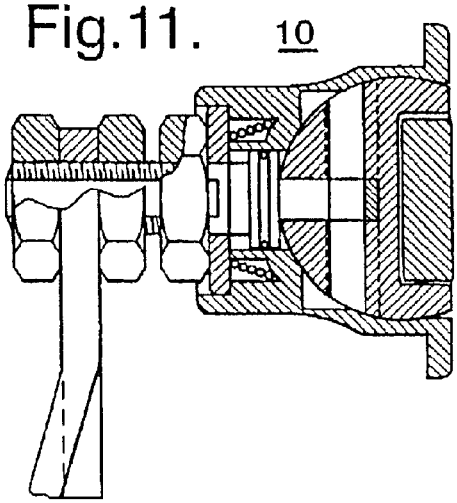
FIG. 11 shows a cross-sectional view through the housing and with mounted partial ball along the bearing axis of the mounted closure drive shaft carrying the rotary bolt.

It can be seen clearly from FIG. 4 that the housing 16 forms at its end 20 a partially spherical bearing surface 76 with a cylindrical bore hole 78 proceeding from it. In this bearing surface, a partial ball 80 (see FIG. 6) is provided with a first bearing 82 for a closure drive shaft 84 extending through the cylindrical bore hole 78. Further, the partial ball 80 has a second bearing 86 for the actuation lever 24 which can be seen in FIG. 4. The two bearings 82 and 86 have axes 88 and 90 which extend parallel to one another and parallel to the plane of the thin wall 14. This enables a rotation of the partial ball around an axis which lies parallel to the axes 90 and 88 and extends through the center of the ball curvature, so as to enable rotation of the partial ball 80 with respect to the housing 20 and swiveling of the actuation lever 24 with respect to the partial ball 80 around an axis vertical to the closure drive shaft 84 and vertical to the lever extension 92 (see FIG. 2). Although the axis 88 does not coincide with the center of the ball as is preferably the case according to FIGS. 5 and 6, a movement is nevertheless possible in case the first bearing 88 is formed by a slot 94 which extends in the partial ball in the direction of the center of the ball and forms an annulus sector, the end 96 of the closure drive shaft 84 extending into the slot 94 as can be seen from FIG. 6, and the slot 94 has undercuts 100 which extend coaxial to the base of the annulus sector 98 and a transverse pin 101 arranged near the end 96 of the closure drive shaft 84 slides along these undercuts 100 (see FIG. 10). When the slot has a rectangular cross section, these undercuts 100 can be formed by grooves extending substantially vertical to the walls of the slot 94 or also by slot-shaped openings such as those shown particularly in FIG. 6. The sliding surfaces 100 formed by the grooves or slot-shaped openings have in particular a radial distance 105 from the spherical surface which decreases continuously (in the direction of the end of the groove facing the cut-off end 103 of the partial ball 80) (see FIG. 9).

Figure 13:
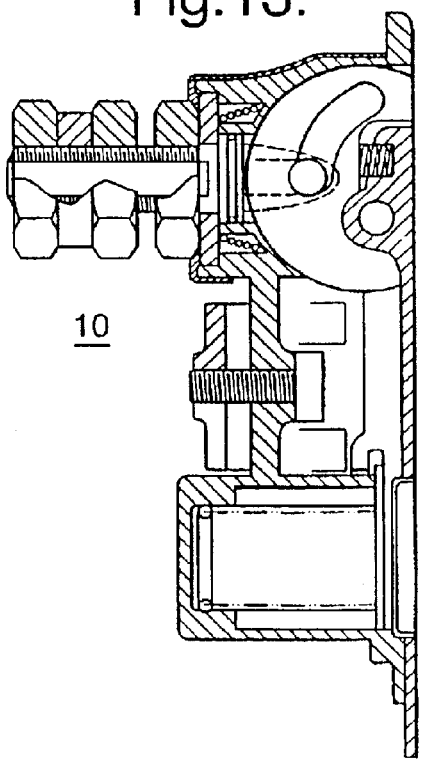
FIGS. 13, 14 and 15 show views similar to that in FIG. 4 of the closure with three successive positions of the hand lever during the opening process.
Figure 14:
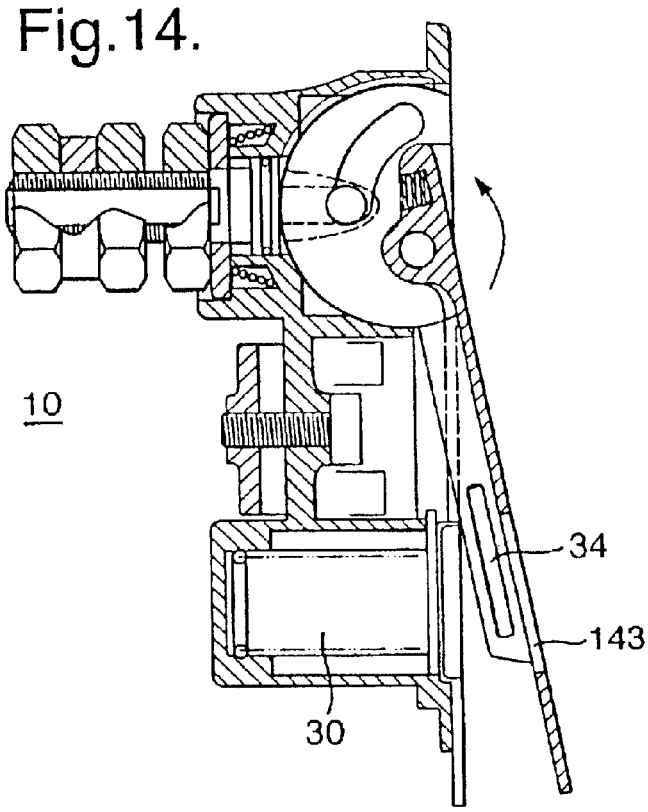
Figure 15:
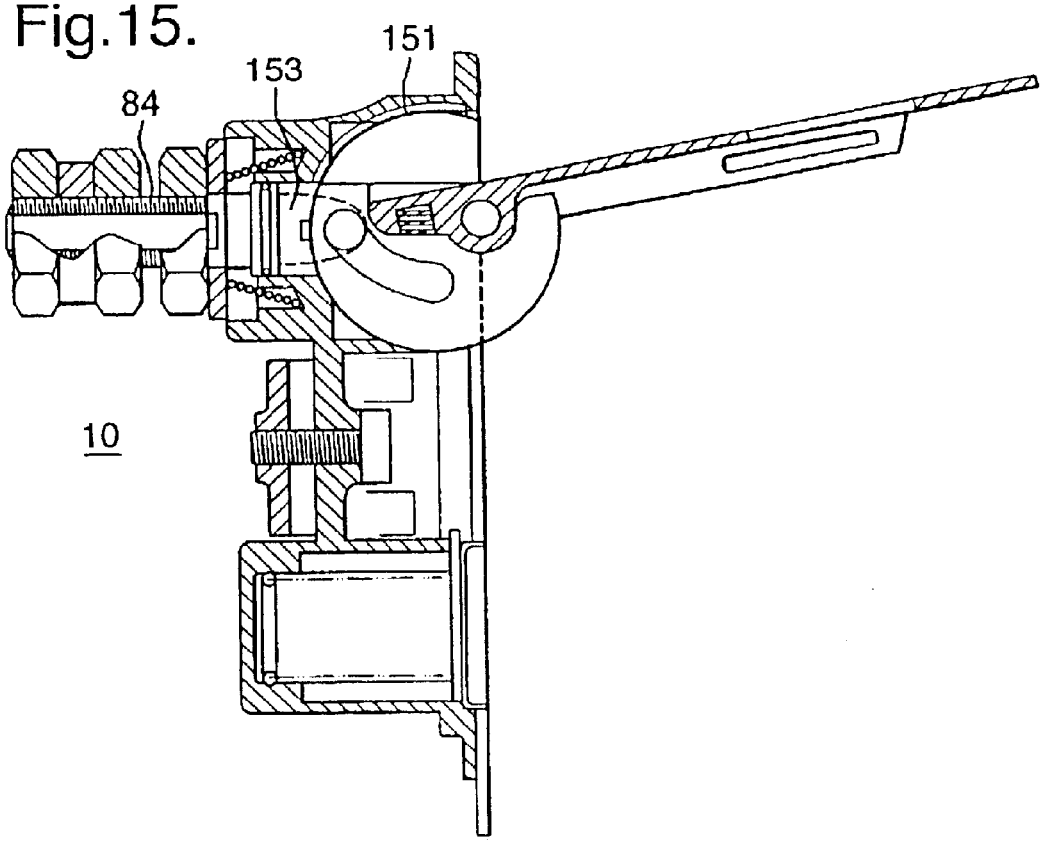

This results in the following kind of operation: First, from its folded-in position shown in FIG. 4 in which it barely projects over the housing flange surface (FIGS. 4 and 13), the actuation lever 24 is swiveled out of a dish formed by the housing (FIG. 5) in counterclockwise direction against the force of a pressure spring 107 around the axis 90. This is achieved most simply by pressing on the roughened or corrugated surface 109 of the hand lever which is located above the axis 90 in the view according to FIG. 4 (shorter lever arm) and therefore leads to a swiveling movement against the force of the spring 107 in the opposite clockwise direction, so that the lower end of the lever (longer lever arm) is released. This movement against the spring force of spring 107 takes place until the lever strikes the inner surface 111 of the partially spherical body 80 by its end receiving the spring 107 (see FIG. 14), whereupon the lower end of the lever is released from the dish and can be grasped. With appropriately large leverage, the hand lever can now rotate the ball 80 around an axis extending parallel to axis 90 and running through the center of the ball. The pin forming the axis 88 at the end of the actuation shaft 84 in the groove 113 forming the undercuts 100 wanders from one end of the groove 113 having a large radial distance from the spherical surface to the opposite end which has a small radial distance from the surface of the ball. Due to this decreasing distance, the actuation shaft 84 is driven by the pressure of a spring 115 so as to wander outward along its longitudinal extension, that is, in the direction of arrow 117. A rotary bolt or a sash fastener 121 (see FIG. 5) supported by the actuation shaft 84 is accordingly removed from the backgrip surface 123 which is formed, for example, by a frame part 119, so that the pressing pressure that may exist between the sash 121 and the backgrip surface 123 is reduced. The end position of the lever selected in this case is shown in FIG. 15.

The actuation lever 24 can now be brought back into its original position with respect to the partial ball 80, so that it is exactly vertical, for example, and can accordingly be used like a screwdriver, whereupon a rotational force can be exerted upon the actuation lever by means of which the ball is caused to rotate together with the shaft 84 around its axis. During this rotational movement, the closure, in this case the sash tongue 121, moves away from the backgrip surface 123 into a position in which the backgrip surface is released, whereupon the door can then be opened. Also, a diagonal end position is conceivable.

The closing process is the reverse. The door is locked again in that the sash bolt 121 is initially brought into a position that is rotated by 90° compared to the position shown in FIG. 5 in the manner already described above. The door is then pressed shut and by means of the vertically (or diagonally) projecting hand lever 24 the ball 80 is rotated until the sash bolt 121 has reached its position shown in FIG. 5. The hand lever 24 is now pressed into its folded-in position, wherein it presses on the area 125, whereupon the ball 80 is swiveled in the clockwise direction around an axis extending through the center of the ball parallel to the door surface until it finally has again reached the position shown in FIG. 4. The radial distance between the spherical surface and the sliding path of the undercuts, that is, distance 105, increases during this movement, so that the actuation shaft 84 is pulled into the housing, that is, opposite the direction of arrow 117. During this process, the bolt 121 presses against the backgrip 123 of the housing 119 or the like.

Therefore, the tensile force on the sash 121 is relatively small during the rotation of the sash, so that the torque to be applied for rotating the sash remains relatively small. On the other hand, in the end position of the closure as is shown in FIG. 5 a relatively high pressing force can be ensured by tightening the actuation shaft 94, so that the door ensures a good pressing closure also in case of flexible seal devices, for example.

Figure 7:
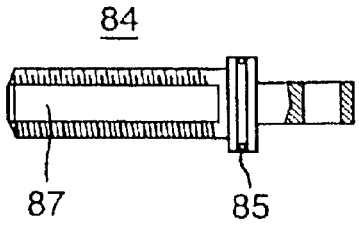
FIG. 7 shows a side view of the closure drive shaft in partial section.
Figure 8:
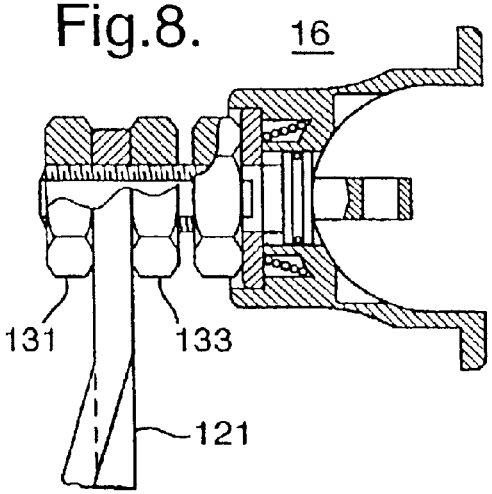
FIG. 8 shows a cross-sectional view through the housing along the bearing axis of the inserted closure drive shaft.

An annular groove in the housing serves to receive the spring 115, for example, a plate spring, or a helical pressure spring. This annular groove is accessible from the outside and is covered by a plate 127 against which the spring is supported and which is held in turn by a nut 129 which is screwed onto an external thread of the shaft 84. In the area of the shaft bearing support, there are also seal devices 85 (FIG. 7) which need not be described further in this connection since the average person skilled in the art will be familiar with them. Balls and lock nuts 129 keep the entire arrangement stable based on the pressure force of the spring 115. Two other lock nuts 131, 133 serve to adjust the distance of the rotary bolt 121 from the backgrip surface 123. Flattened portions 87 in connection with necked-down portions in the tongue opening for the drive shaft 84 cause the tongue 121 to be rigid with respect to rotation relative to the shaft 84.

It is advantageous when the pin 101 running in the groove 113 snaps into the closure position of the rotary clamping closure. This can be achieved in that the distance 105 at the opposite end of the groove is reduced again somewhat as is indicated by reference number 135 in FIG. 6. The closure can accordingly also not move out of its locked position automatically during a shaking movement, which would otherwise be possible when the hand lever 24 is left unlocked.

The bearing support for the axis 90 formed by the cut-off surface 103 of the partial ball 80 can be realized in that two shoulders which are located opposite one another proceed from this cut-off surface and have round bore holes in which a bearing pin for the bearing 90 can be inserted. It is even more advantageous when the partial ball 80 is somewhat greater than a hemisphere and a countersink is formed in its cut-off surface 103, the bearing 90 for the lever being formed in this countersink. This results in side walls 137 which tightly enclose the narrow sides 139 and the end side 141 (see FIG. 2) of the shorter end of the actuation lever 24 as can be seen clearly in FIG. 2 and FIG. 10.

Figure 12:
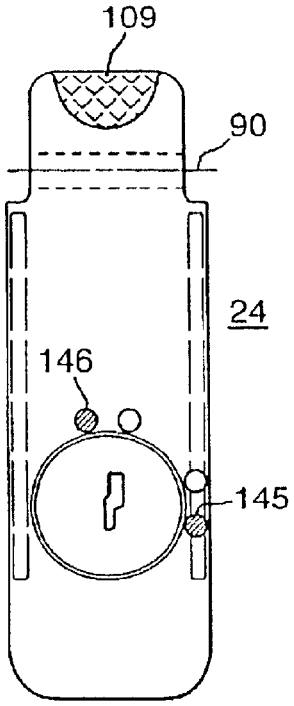
FIG. 12 shows a top view of the hand lever.

The free end of the lever has a round opening 143 through which the end face of the cylinder lock 30 extends and is accordingly accessible for insertion of a key. The surface of a shoulder forming the lock finger 32 or the like can be made visible through additional openings 145 and 146 (FIG. 12). For example, the shoulder can indicate red in position 145 in which the locked position is achieved and green in the unlocked position 146. In this way, the closure state is indicated visually.

It is sometimes advisable to ensure that a rotating movement of the drive shaft 84 can not take place through the partial ball until the partial ball has reached a desired position (diagonal position or the position shown in FIG. 15). For this purpose, a guide groove 151 is provided in the spherical surface of the housing which lies in the longitudinal sectional plane of the housing and guides a guide nose 153 that is carried by the partial ball in such a way that the ball can be rotated only around an axis which is vertical to the longitudinal sectional plane and leads through the center of the ball until the nose 153 has reached the axis running through the drive shaft 84 (see FIG. 15) in which position the nose no longer prevents a rotating movement around this axis.

Commercial Applicability

The invention is commercially applicable in switch cabinet construction.

While the foregoing description and drawings represent the present invention, it will be obvious to those skilled in the art that various changes may be made therein without departing from the true spirit and scope of the present invention.

What is claimed is:

1. A closure fastener for mounting in an opening in a thin wall such as a sheet metal cabinet door, a sheet metal cabinet flap, a sheet metal cabinet housing wall or the like, where the closure fastener has an elongated, substantially cup-shaped housing whose edge passes into a flange and which has, at one end, a bearing support for an actuation lever and, at its other end, a lock device for the actuation lever in its position in which it is swiveled into the housing, and a fastening device which clamps the thin wall between itself and the flange, an improvement therein comprising that:

the housing has a partially spherical bearing surface with a cylindrical bore hole proceeding from it;

a partial ball with a first bearing for a closure drive shaft extending through the cylindrical bore hole; and a second bearing for the actuation lever being arranged in the partial ball;

the two bearings enabling a rotation of the partial ball in relation to the housing and a swiveling of the actuation lever in relation to the partial ball around an axis vertical to the closure drive shaft and to the extension of the lever, where the first bearing is formed by a slot which extends in the partial ball in the direction of the center of the ball and forms an annulus sector, the end of the closure drive shaft extends into the end of the slot and the slot has undercuts extending substantially coaxial to the annulus sector, a transverse pin arranged near the end of the closure drive shaft for sliding along at these undercuts.

2. The closure fastener according to claim 1, wherein the undercuts are formed by grooves extending in the walls of the slot or by slot-shaped openings.

3. The closure fastener according to claim 2, wherein the sliding surfaces formed by the grooves or slot-shaped openings have a substantially continuously decreasing radial distance from the spherical surface in the direction of the end of the groove facing the cut-off part of the partial ball.

4. The closure fastener according to claim 3, wherein the spacing at the opposite end of the groove decreases again.

5. A closure fastener for mounting in an opening in a thin wall such as a sheet metal cabinet door, a sheet metal cabinet flap, a sheet metal cabinet housing wall or the like, where the closure fastener has an elongated, substantially cup-shaped housing whose edge passes into a flange and which has, at one end, a bearing support for an actuation lever and, at its other end, a lock device for the actuation lever in its position in which it is swiveled into the housing, and a fastening device which clamps the thin wall between itself and the flange, an improvement therein comprising that:

the housing has a partially spherical bearing surface with a cylindrical bore hole proceeding from it;

a partial ball with a first bearing for a closure drive shaft extending through the cylindrical bore hole; and a second bearing for the actuation lever being arranged in the partial ball;

the two bearings enabling a rotation of the partial ball in relation to the housing and a swiveling of the actuation lever in relation to the partial ball around an axis vertical to the closure drive shaft and to the extension of the lever, where two oppositely located shoulders proceed from the cut-off surface of the partial ball and form a support for a pin which forms the second bearing and on which pin the actuation lever is held so as to be swivelable against a spring force, wherein the shoulders are formed by side walls which enclose the narrow sides and front side of the shorter lever arm of the actuation lever at a slight distance.

6. A closure fastener for mounting in an opening in a thin wall such as a sheet metal cabinet door, a sheet metal cabinet flap, a sheet metal cabinet housing wall or the like, where the closure fastener has an elongated, substantially cup-shaped housing whose edge passes into a flange and which has, at one end, a bearing support for an actuation lever and, at its other end, a lock device for the actuation lever in its position in which it is swiveled into the housing, and a fastening device which clamps the thin wall between itself and the flange, an improvement therein comprising that:

the housing has a partially spherical bearing surface with a cylindrical bore hole proceeding from it;

a partial ball with a first bearing for a closure drive shaft extending through the cylindrical bore hole; and a second bearing for the actuation lever being arranged in the partial ball;

the two bearings enabling a rotation of the partial ball in relation to the housing and a swiveling of the actuation lever in relation to the partial ball around an axis vertical to the closure drive shaft and to the extension of the lever, where a clamping fastening is provided between the two ends of the housing, wherein the cup-shaped housing forms a necked-down portion approximately in the center of its longitudinal extension, which necked-down portion can receive a fastening clip in such a way that when the legs of the clip are pressed together or are not pressed apart the outer alignment of the housing is not changed or altered by these legs, wherein the housing has surfaces in the area of the leg ends of the fastening clip, which surfaces press the legs apart when the fastening clip is tightened until they strike edge areas located around the opening in the thin wall.

7. A closure fastener for mounting in an opening in a thin wall such as a sheet metal cabinet door, a sheet metal cabinet flap, a sheet metal cabinet housing wall or the like, where the closure fastener has an elongated, substantially cup-shaped housing whose edge passes into a flange and which has, at one end, a bearing support for an actuation lever and, at its other end, a lock device for the actuation lever in its position in which it is swiveled into the housing, and a fastening device which clamps the thin wall between itself and the flange, an improvement therein comprising that:

the housing has a partially spherical bearing surface with a cylindrical bore hole proceeding from it;

a partial ball with a first bearing for a closure drive shaft extending through the cylindrical bore hole; and a second bearing for the actuation lever being arranged in the partial ball;

the two bearings enabling a rotation of the partial ball in relation to the housing and a swiveling of the actuation lever in relation to the partial ball around an axis vertical to the closure drive shaft and to the extension of the lever, where a clamping fastening is provided between the two ends of the housing, wherein the cup-shaped housing forms a necked-down portion approximately in the center of its longitudinal extension, which necked-down portion can receive a fastening clip in such a way that when the legs of the clip are pressed together or are not pressed apart the outer alignment of the housing is not changed or altered by these legs, wherein the fastening clip has legs which spring outward.

* * * * *